US007591164B2

(12) United States Patent
Duggan et al.

(10) Patent No.: US 7,591,164 B2
(45) Date of Patent: Sep. 22, 2009

(54) METHOD OF MANUFACTURING A SPLINED MEMBER FOR USE IN A DRIVESHAFT ASSEMBLY

(75) Inventors: James A. Duggan, Temperance, MI (US); Thomas J. Keller, Bristol, VA (US)

(73) Assignee: Dana Automotive Systems Group, LLC, Toledo, OH (US)

( * ) Notice: Subject to any disclaimer, the term of this patent is extended or adjusted under 35 U.S.C. 154(b) by 29 days.

(21) Appl. No.: 11/221,594

(22) Filed: Sep. 8, 2005

(65) Prior Publication Data

US 2006/0048556 A1 Mar. 9, 2006

Related U.S. Application Data

(60) Provisional application No. 60/608,021, filed on Sep. 8, 2004.

(51) Int. Cl.
*B21D 17/02* (2006.01)

(52) U.S. Cl. ..... 72/370.01; 72/76; 72/342.1; 72/370.13

(58) Field of Classification Search ..... 72/342.1, 72/342.94, 367.1, 370.01, 370.04, 370.13, 72/370.14, 370.24, 370.26, 76, 264, 267, 72/352, 358, 359, 368; 464/183, 184
See application file for complete search history.

(56) References Cited

U.S. PATENT DOCUMENTS 3,263,474 A 8/1966 Pentland
3,566,651 A 3/1971 Tlaker
3,643,485 A 2/1972 Marcovitch
3,961,513 A * 6/1976 Stahly ..... 72/58
4,093,474 A * 6/1978 Sperry et al. ..... 148/523
4,470,290 A 9/1984 Jungesjo
5,213,250 A 5/1993 Simon
5,333,775 A * 8/1994 Bruggemann et al. ..... 228/157
5,643,093 A * 7/1997 Breese ..... 464/183
5,771,737 A 6/1998 Yaegashi
5,829,911 A * 11/1998 Yokota et al. ..... 403/359.6
5,981,921 A * 11/1999 Yablochnikov ..... 219/603

(Continued)

FOREIGN PATENT DOCUMENTS

GB 829122 7/1956

(Continued)

*Primary Examiner*—Edward Tolan
(74) *Attorney, Agent, or Firm*—Marshall & Melhorn, LLC

(57) ABSTRACT

A method of manufacturing a splined member avoids the generation of waste material and minimizes the amount of dimensional inaccuracies. A hollow cylindrical workpiece is initially provided from a material having a relatively high elongation characteristic. The material used to form the workpiece may be AA-5154 grade aluminum alloy having an elongation characteristic that is in the range of from about 20% to about 30%, preferably in the range of from about 22% to about 28%, and most preferably about 25%. A mandrel having a plurality of external splines is inserted within workpiece, and the workpiece is deformed into engagement with the mandrel to form a splined member using a swaging process, such a rotary swaging or feed swaging. The splined member is thus formed having a plurality of internal splines and a cylindrical outer surface. The use of the swaging process avoids the generation of waste material. Also, dimensional accuracy is improved because the splined member is shaped in accordance with the precisely formed mandrel, which eliminates dimensional variations that can result from known machining practices.

12 Claims, 8 Drawing Sheets

U.S. PATENT DOCUMENTS

| | | | | |
|---|---|---|---|---|
| 6,001,018 | A * | 12/1999 | Breese | 464/183 |
| 6,033,499 | A * | 3/2000 | Mitra | 148/688 |
| 6,038,901 | A | 3/2000 | Stein et al. | |
| 6,257,041 | B1 | 7/2001 | Duggan | |
| 6,718,811 | B2 * | 4/2004 | Drillon et al. | 72/208 |
| 6,959,476 | B2 * | 11/2005 | Li et al. | 29/421.1 |
| 7,028,404 | B1 * | 4/2006 | Poirier et al. | 29/897.2 |
| 7,062,834 | B2 * | 6/2006 | Patterson et al. | 29/505 |
| 2005/0257924 | A1 * | 11/2005 | Buchanan | 165/184 |

FOREIGN PATENT DOCUMENTS

| | | |
|---|---|---|
| GB | 2090942 | 7/1982 |
| JP | 62146234 | 6/1987 |

* cited by examiner

METHOD OF MANUFACTURING A SPLINED MEMBER FOR USE IN A DRIVESHAFT ASSEMBLY

CROSS-REFERENCE TO RELATED APPLICATIONS

This application claims the benefit of U.S. Provisional Application No. 60/608,021, filed Sep. 8, 2004, the disclosure of which is incorporated herein by reference.

BACKGROUND OF THE INVENTION

This invention relates in general to methods of manufacturing splined members, such as are commonly used in the driveshaft assemblies. In particular, this invention relates to an improved method of manufacturing a splined member for use in such a driveshaft assembly.

Drive train systems are widely used for generating power from a source and for transferring such power from the source to a driven mechanism. Frequently, the source generates rotational power, and such rotational power is transferred from the source to a rotatably driven mechanism. For example, in most land vehicles in use today, an engine/transmission assembly generates rotational power, and such rotational power is transferred from an output shaft of the engine/transmission assembly through a driveshaft assembly to an input shaft of an axle assembly so as to rotatably drive the wheels of the vehicle. To accomplish this, a typical driveshaft assembly includes a hollow cylindrical driveshaft tube having a pair of end fittings, such as a pair of tube yokes, secured to the front and rear ends thereof. The front end fitting forms a portion of a front universal joint that connects the output shaft of the engine/transmission assembly to the front end of the driveshaft tube. Similarly, the rear end fitting forms a portion of a rear universal joint that connects the rear end of the driveshaft tube to the input shaft of the axle assembly. The front and rear universal joints provide a rotational driving connection from the output shaft of the engine/transmission assembly through the driveshaft tube to the input shaft of the axle assembly, while accommodating a limited amount of angular misalignment between the rotational axes of these three shafts.

Not only must a typical drive train system accommodate a limited amount of angular misalignment between the source of rotational power and the rotatably driven device, but it must also typically accommodate a limited amount of relative axial movement therebetween. For example, in most vehicles, a small amount of relative axial movement frequently occurs between the engine/transmission assembly and the axle assembly when the suspension of the vehicle articulates during normal operation, such as when the vehicle is driven over a bumpy road. To address this, it is known to provide a slip joint in the driveshaft assembly. A typical slip joint includes first and second members that have respective structures formed thereon that cooperate with one another for concurrent rotational movement, while permitting a limited amount of axial movement to occur therebetween.

One type of slip joint commonly used in conventional driveshaft assemblies is a sliding spline type slip joint. A typical sliding spline type of slip joint includes male and female members having respective pluralities of splines formed thereon. The male member is generally cylindrical in shape and has a plurality of outwardly extending splines formed on the outer surface thereof. The male member may be formed integrally with or secured to an end of the driveshaft assembly described above. The female member, on the other hand, is generally hollow and cylindrical in shape and has a plurality of inwardly extending splines formed on the inner surface thereof. The female member may be formed integrally with or secured to a yoke that forms a portion of one of the universal joints described above. To assemble the slip joint, the male member is inserted within the female member such that the outwardly extending splines of the male member cooperate with the inwardly extending splines of the female member. As a result, the male and female members are connected together for concurrent rotational movement. However, the outwardly extending splines of the male member can slide relative to the inwardly extending splines of the female member to allow a limited amount of relative axial movement to occur between the engine/transmission assembly and the axle assembly of the drive train system.

In the past, the male and female splined members have usually been formed from steel, and the splines of such members have been manufactured by machining portions of such members so as to provide the desired splines. Although this method has been effective, the use of the machining process to form the splines has resulted in the generation of waste material, which is inefficient. Also, the use of the conventional machining process to form the splines can generate dimensional variances that result from normal manufacturing tolerances and practices. More recently, the male and female splined members have usually been formed from aluminum alloys having relatively low elongation factors, such as 6061-T6 aluminum. The use of these aluminum alloys has been found to be desirable because aluminum is much lighter in weight than steel. However, the use of the machining process to form the splines in the aluminum members still results in the generation of waste material and dimensional inaccuracies. Thus, it would be desirable to provide an improved method of manufacturing a splined member, such as for use in a vehicular driveshaft assembly, that avoids the generation of waste material and minimizes the amount of dimensional inaccuracies.

SUMMARY OF THE INVENTION

This invention relates to an improved method of manufacturing a splined member, such as for use in a vehicular driveshaft assembly, that avoids the generation of waste material and minimizes the amount of dimensional inaccuracies. A hollow cylindrical workpiece is initially provided from a material having a relatively high elongation characteristic. The material used to form the workpiece may be AA-5154 grade aluminum alloy having an elongation characteristic that is in the range of from about 20% to about 30%, preferably in the range of from about 22% to about 28%, and most preferably about 25%. A mandrel having a plurality of external splines is inserted within the workpiece, and the workpiece is deformed into engagement with the mandrel to form a splined member using a swaging process, such a rotary swaging or feed swaging. The splined member is thus formed having a plurality of internal splines and a cylindrical outer surface. The use of the swaging process avoids the generation of waste material. Also, dimensional accuracy is improved because the splined member is shaped in accordance with the precisely formed mandrel, which eliminates dimensional variations that can result from conventional machining practices.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
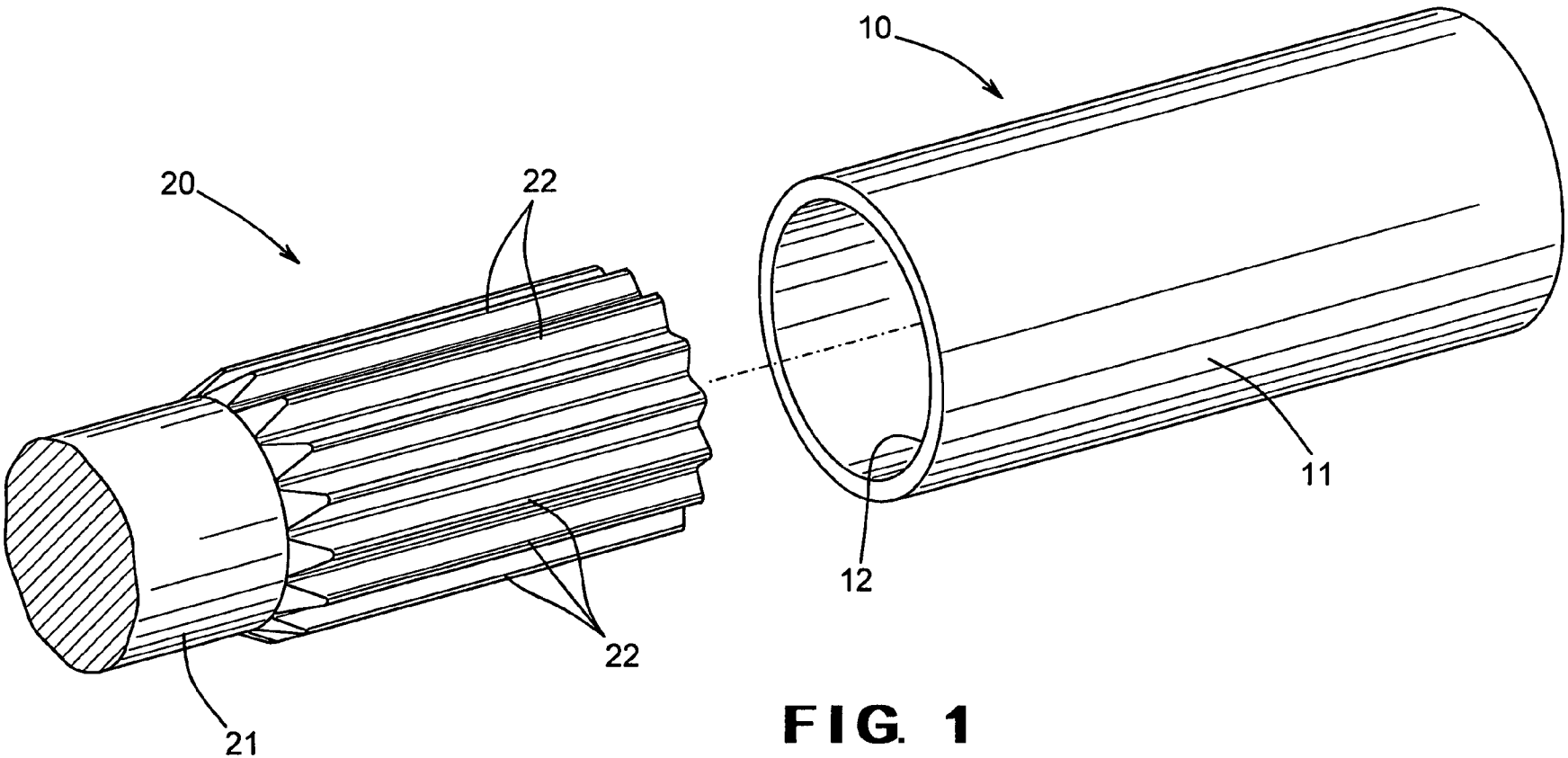
FIG. 1 is an exploded perspective view of a workpiece and a mandrel shown prior to the commencement of a first embodiment of a method of manufacturing a splined member in accordance with this invention.

Referring now to the drawings, there is illustrated in FIGS. 1 through 10 a first embodiment of a method of forming a splined member in accordance with this invention. The splined member may, for example, be used in a driveshaft assembly of a vehicular drive train system. However, it will be appreciated that the splined member manufactured in accordance with the method of this invention can be used in any desired environment for any desired purpose.

As shown in FIG. 1, a workpiece, indicated generally at 10, and a mandrel, indicated generally at 20, are initially provided. The illustrated workpiece 10 is generally hollow and cylindrical in shape, having an outer surface 11 and an inner surface 12 that define a wall thickness that is generally uniform through the length thereof. However, the workpiece 10 may be formed having any desired shape or wall thickness.

The workpiece 10 is formed from a material having a relatively high elongation characteristic. As used herein, the term "elongation characteristic" is used to designate a factor that is representative of the amount of ductility of the material used to form the workpiece 10. The elongation factor varies directly with the amount of ductility of the material, i.e., the higher the elongation factor, the more ductile the material is, and vice versa. The elongation characteristic of the material used to form the workpiece 10 can be determined in any desired manner. For example, the elongation characteristic of the material can be determined empirically by initially providing a pair of marks at spaced apart locations on the outer surface of a piece of the material and measuring the distance therebetween. Then, the piece of the material is subjected to tensile forces, which causes it to elongate and increase the distance between the two marks. After a certain amount of such elongation has occurred, the piece of the material will fracture into two pieces. Following such fracture, the two pieces of the material are disposed adjacent to one another, and the length of the extension before the fracture occurred is measured as the distance between the two marks. By dividing the extended length between the two marks by the original length therebetween, the elongation factor can be expressed as a percentage of the original length.

As used herein, the term "relatively high elongation characteristic" is used to designate an elongation characteristic that is in the range of from about 20% to about 30%, preferably in the range of from about 22% to about 28%, and most preferably about 25%. The workpiece 10 is preferably formed from an aluminum alloy material having a relatively high elongation characteristic. One example of a material that has a relatively high elongation characteristic is AA-5154 grade aluminum alloy having an H112 temper and a generally uniform wall thickness of about one-quarter inch.

Alternatively, the workpiece 10 can be formed from a material having a relatively low elongation characteristic, but which is subjected to a softening process to provide it with a relatively high elongation characteristic. One well known softening process is a retrogression heat treatment process. Generally speaking, the retrogression heat treatment process is performed by rapidly heating the workpiece 10 to a sufficient temperature that provides for full or partial softening thereof, followed by relatively rapid cooling. Notwithstanding this cooling, the workpiece 10 retains the full or partial softening characteristics for at least a relatively short period of time. The deformation of the workpiece 10 is performed in the manner described below while the workpiece 10 retains the full or partial softening characteristics.

Figures 2, 3:
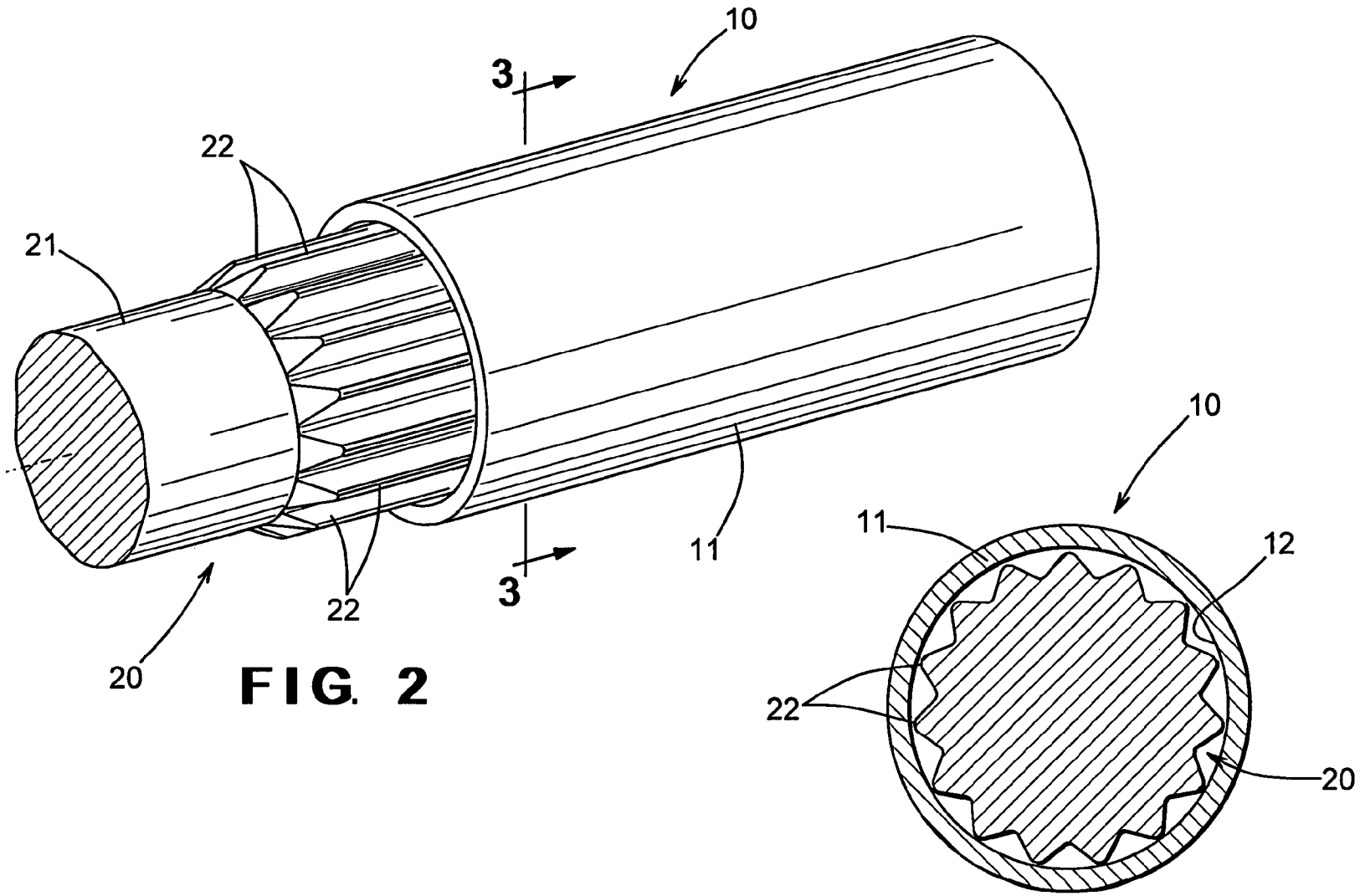
FIG. 2 is a perspective view similar to FIG. 1 showing the workpiece and the mandrel disposed in a co-axially overlapping relationship.
FIG. 3 is a sectional elevational view taken of the assembled workpiece and mandrel taken along line 3-3 of FIG. 2.

The illustrated mandrel 20 is generally cylindrical in shape, including a supporting shaft portion 21 and an end portion having a plurality of axially extending external splines 22 formed on the outer surface thereof. Preferably, the external splines 22 of the mandrel 20 define an outer diameter that is smaller than an inner diameter defined by the inner surface 12 of the workpiece 10. As a result, the mandrel 20 can be quickly and easily inserted co-axially within the workpiece 10, as shown in FIGS. 2 and 3. The mandrel 20 is inserted within the workpiece 10 for deforming the workpiece 10 into a desired shape to form a splined member.

Figures 4, 5:
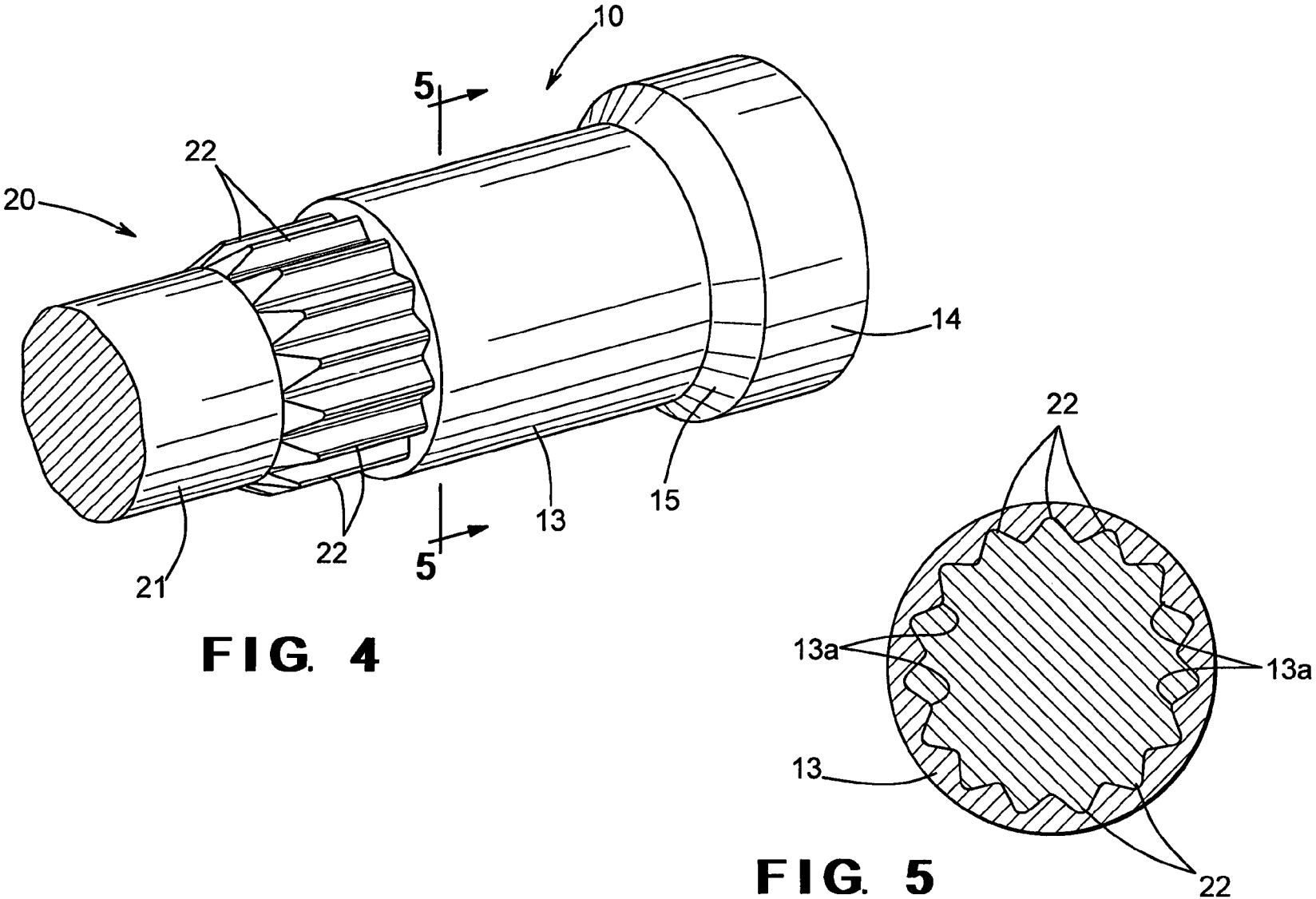
FIG. 4 is a perspective view similar to FIG. 2 showing the workpiece after it has been deformed about the mandrel.
FIG. 5 is a sectional elevational view of the deformed workpiece and the mandrel taken along line 5-5 of FIG. 4.

Thus, the next step in the method is to deform a portion of the workpiece 10 about the axially extending external splines 22 of the mandrel 20, as shown in FIGS. 4 and 5. This can be accomplished by any desired process. Preferably, however, the portion of the workpiece 10 is deformed about the axially extending external splines 22 of the mandrel 20 by a swaging process, such as by rotary swaging or feed swaging. During this swaging process, a conventional swaging tool (not shown) is moved into engagement with a portion of the outer surface 11 (see FIGS. 1 through 3) of the workpiece 10. As a result, the portion of the workpiece 10 that is engaged by the swaging tool is reduced in diameter (such as shown at 13 in FIGS. 4 and 5) relative the portion of the workpiece 10 that is not engaged by the swaging tool, which remains at its original diameter (such as shown at 14 in FIGS. 4 and 5). Consequently, a transition portion 15 is defined in the workpiece 10 between the reduced diameter portion 13 and the unreduced diameter portion 14. The transition portion 15 of the workpiece 10 is preferably be frusto-conical in shape as illustrated, although such is not required.

Figure 6:
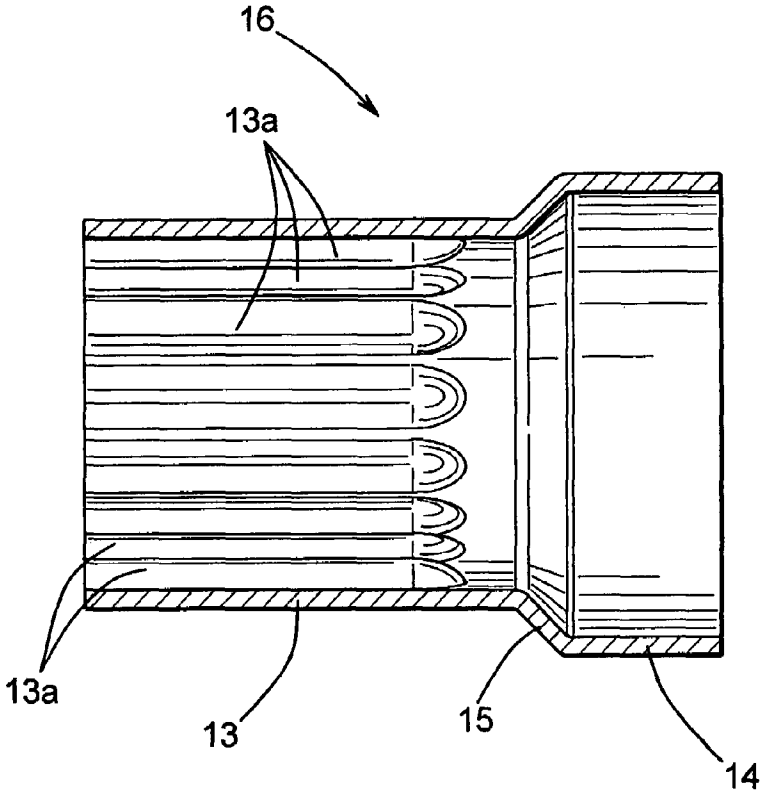
FIG. 6 is a sectional elevational view of the deformed workpiece after it has been removed from the mandrel.

Thereafter, the mandrel 20 is removed from the workpiece 10, as shown in FIG. 6, to provide a rough splined member, indicated generally at 16 in FIG. 6. As a result of this swaging process, the inner surface 12 of the deformed reduced diameter portion 13 of the splined member 16 is moved into engagement with the external splines 22 provided on the end portion of the mandrel 20 and re-shaped to form a plurality of internal splines 13*a* thereon, as shown in FIG. 6. At the same time, however, the outer surface of the deformed reduced diameter portion 13 of the splined member 16 is preferably maintained having its original generally cylindrical shape (albeit with a smaller outer diameter), as also shown in FIG. 6.

Figure 7:
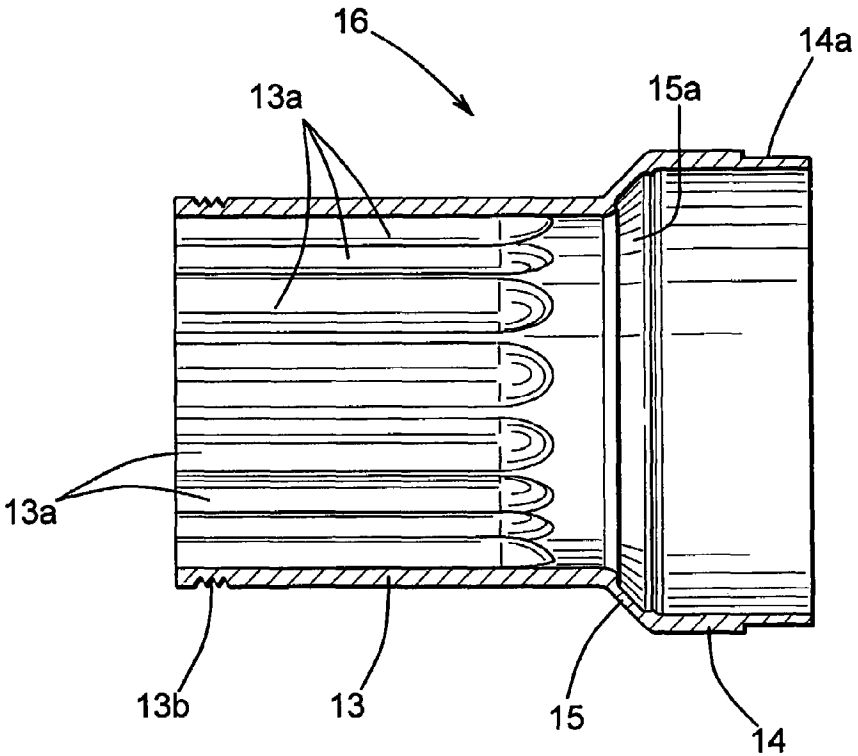
FIG. 7 is a sectional elevational view similar to FIG. 6 showing the deformed workpiece after a machining operation has been performed thereon to form a finished splined member.

Next, portions of the splined member 16 can be machined or otherwise re-shaped to provide a variety of desired structures thereon. For example, as shown in FIG. 7, one or more annular grooves 13*b* can be formed in the outer surface of the deformed reduced diameter portion 13 of the splined member 16. The purpose for these annular grooves 13*b* will be explained below. Also, a counterbore 15*a* can be formed in the inner surface of the splined member 16 at or near the transition portion 15 thereof. The purpose for this counterbore 15*a* will also be explained below. Lastly, an annular recessed area 14*a* can be formed in the outer surface of the unreduced diameter portion 14 of the splined member 16 adjacent to an end thereof. The purpose for this annular recessed area 14*a* will also be explained below.

Figure 8:
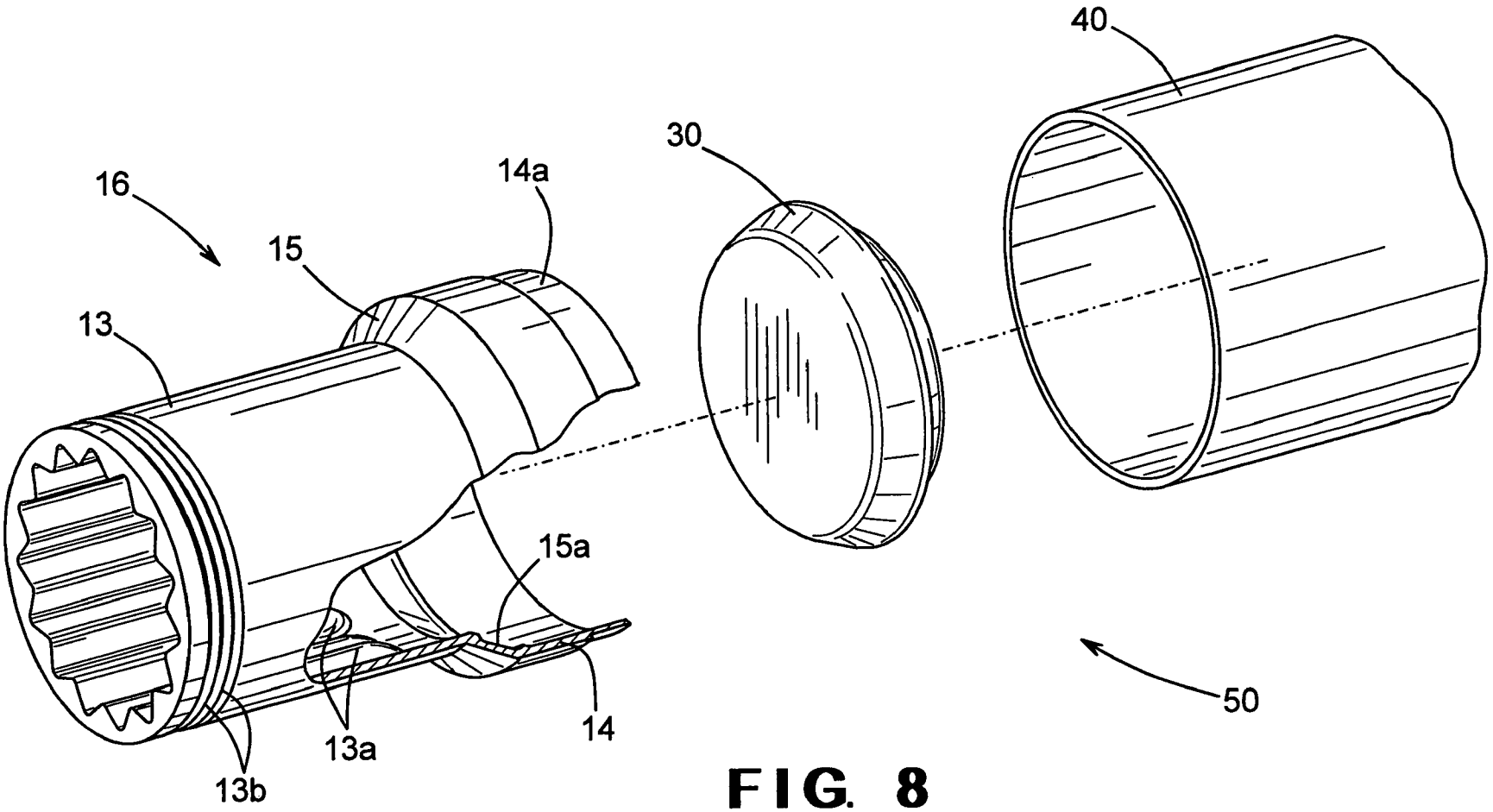
FIG. 8 is an exploded perspective view showing the finished splined member, an internal seal, and an end of a driveshaft tube shown prior to assembly to form a splined driveshaft component.
Figure 9:
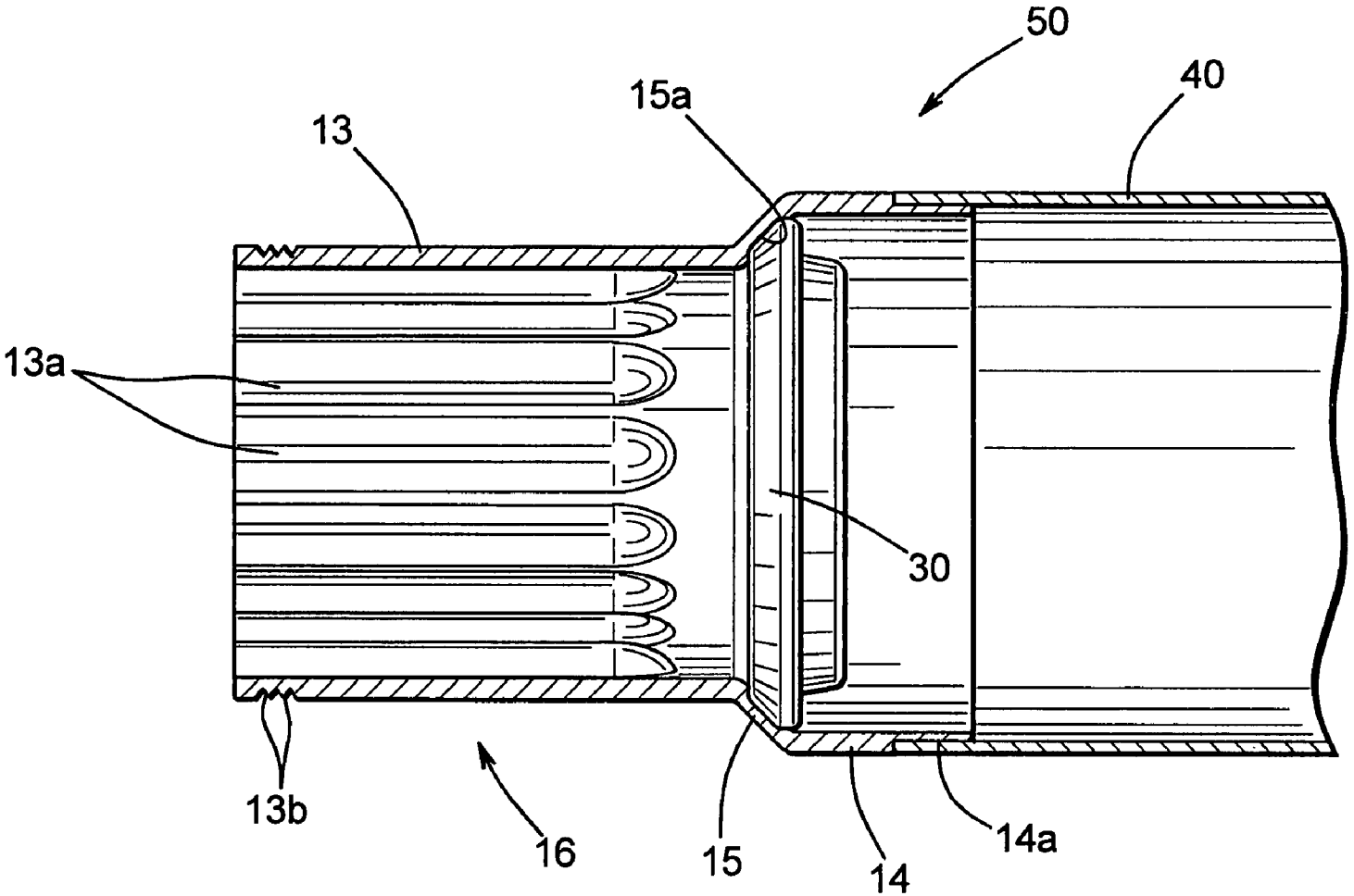
FIG. 9 is a sectional elevational view showing the splined member, the internal seal, and the driveshaft tube in an assembled condition to form a splined driveshaft component.

FIGS. 8 and 9 illustrate the assembly of the splined member 16 with an internal seal 30 and an end of a driveshaft tube 40 to form a splined driveshaft component, indicated generally at 50. Initially, the internal seal 30 (which can be a conventional elastomeric or plastic welch plug) is inserted within the splined member 16 and is press fit into the counterbore 15*a* formed on the inner surface of the transition portion 15 of the splined member 16. Then, the end of the driveshaft tube 40 is moved co-axially about and supported on the annular recess 14*a* provided on the unreduced diameter portion 14 of the splined member 16. Thus, the annular recess 14*a* functions as a tube seat to precisely position the driveshaft 40 relative to the splined member 16. Preferably, the end of the driveshaft tube 40 initially engages the tube seat 14*a* of the splined member 16 in a light press fit relationship. Thereafter, the end of the driveshaft tube 40 can be permanently secured to the splined member 16 in any conventional manner, such as by welding, adhesives, and the like.

Figure 10:
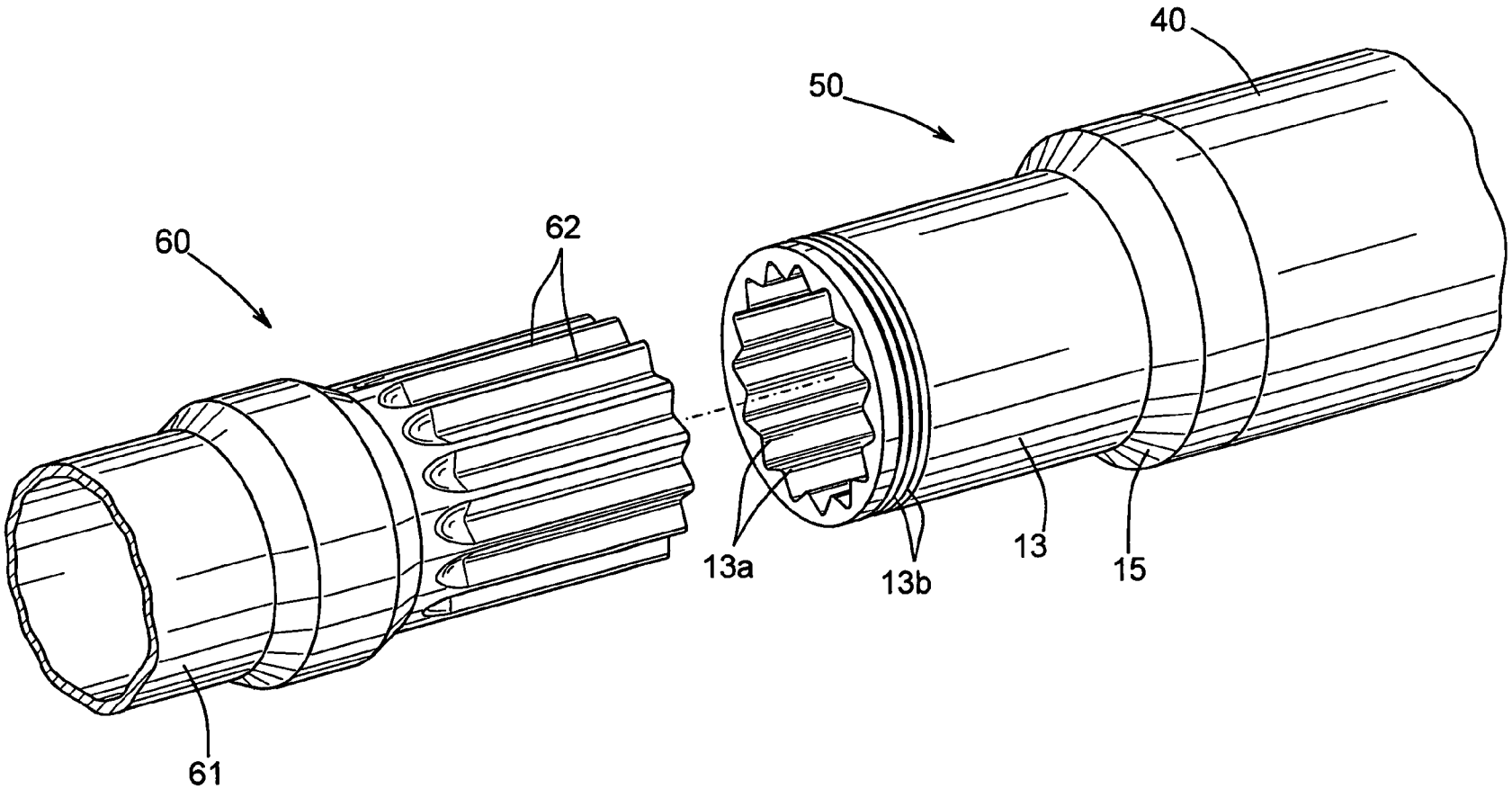
FIG. 10 is an exploded perspective view showing the splined driveshaft component of FIG. 9 and another splined driveshaft component that can be assembled to form a splined driveshaft assembly.

As shown in FIG. 10, the splined driveshaft component 50 is a female splined driveshaft component that can be used with a conventional male splined driveshaft component, such as indicated generally at 60, to form a splined driveshaft assembly. The male splined driveshaft component 60 is conventional in the art and includes a shaft portion 61 that is connected to a male splined portion having a plurality of external splines 62 provided thereon. In a manner that is well known in the art, the external splines 62 of the male splined driveshaft component 60 cooperate with the internal splines 13*a* formed on the female splined driveshaft component 50. As a result, the male splined driveshaft component 60 and the female splined driveshaft component 50 are connected together for concurrent rotational movement. However, the external splines 62 of the male splined driveshaft component 60 can slide relative to the internal splines 13*a* of the female splined driveshaft component 50 to allow a predetermined amount of relative axial movement to occur between the male splined driveshaft component 60 and the female splined driveshaft component 50.

As discussed above, one or more annular grooves 13*b* are formed in the outer surface of the deformed reduced diameter portion 13 of the female splined driveshaft component 50. These annular grooves 13*b* can be provided to facilitate the securement of a first end of a conventional flexible boot (not shown) about the open end of the deformed reduced diameter portion 13 of the female splined driveshaft component 50. A second end of such a flexible boot could also be secured to the outer surface of the male splined driveshaft component 60 to prevent dirt, water, and other contaminants from entering into the region of the cooperating splines 62 and 13*a*. To facilitate the securement of the second end of the flexible boot the outer surface of the male splined driveshaft component 60, one or more similar grooves (not shown) can also be formed in the outer surface of the male splined driveshaft component 60.

Although the method of this invention has been described and illustrated in the context of the formation of a female splined member, it will be appreciated that this invention can be used to form a male splined member as well. To accomplish this, the hollow cylindrical workpiece 10 could be inserted within a hollow cylindrical mandrel (not shown) having a plurality of axially extending internal splines formed on the inner surface thereof. The hollow cylindrical workpiece 10 could then be expanded outwardly, such as by using conventional magnetic pulse forming techniques, so as to form a male splined member having a plurality of axially extending external splines formed on the outer surface thereof.

Figure 11:
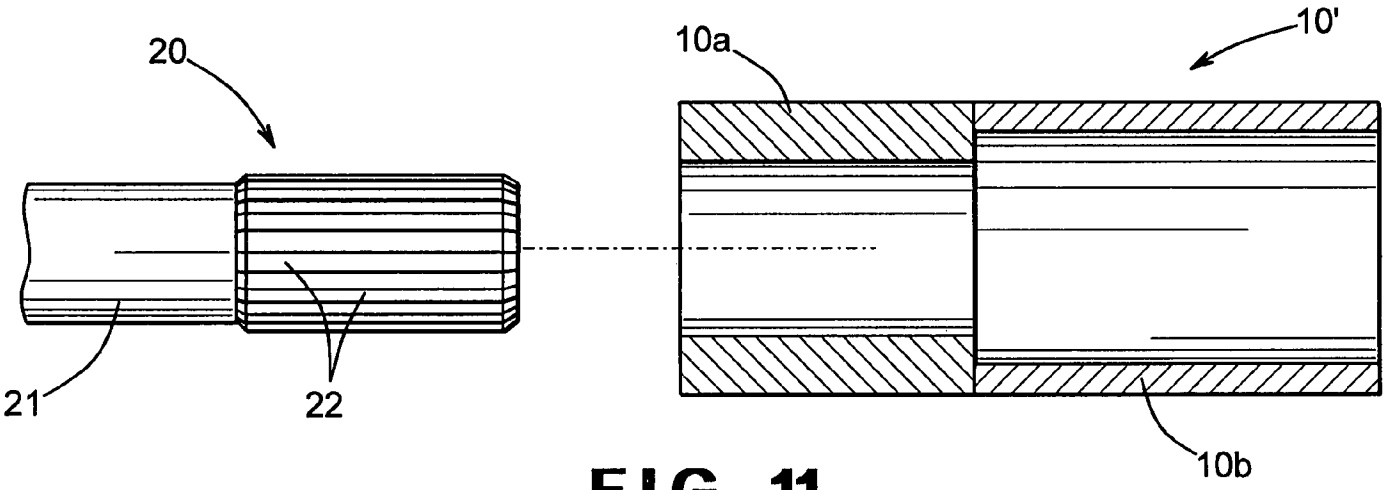
FIG. 11 is an exploded elevational view of a workpiece and a mandrel shown prior to the commencement of a second embodiment of a method of manufacturing a splined member in accordance with this invention.

FIG. 11 is an exploded elevational view of a modified workpiece, indicated generally at 10', and the mandrel 20 shown prior to the commencement of a second embodiment of a method of manufacturing a splined member in accordance with this invention. In this embodiment of the method of this invention, the modified workpiece 10' is generally hollow and cylindrical in shape, similar to the workpiece 10 described and illustrated above. However, the modified workpiece 10' does not have a wall thickness that is generally uniform through the length thereof. Rather, the modified workpiece 10' has a wall thickness that varies from a thicker portion 10*a* to a thinner portion 10*b*. In this embodiment of the invention, the thicker portion 10*a* of the modified workpiece 10' and the thinner portion 10*b* of the modified workpiece 10' are formed from separate pieces of material that are secured together using any conventional process. For example, the thicker portion 10*a* of the modified workpiece 10' and the thinner portion 10*b* of the modified workpiece 10' can be secured together by a conventional friction welding process. The mandrel 20 can be inserted within the thicker portion 10*a* of the modified workpiece 10' to form the internal splines 13*a* in the manner described above.

Figure 12:
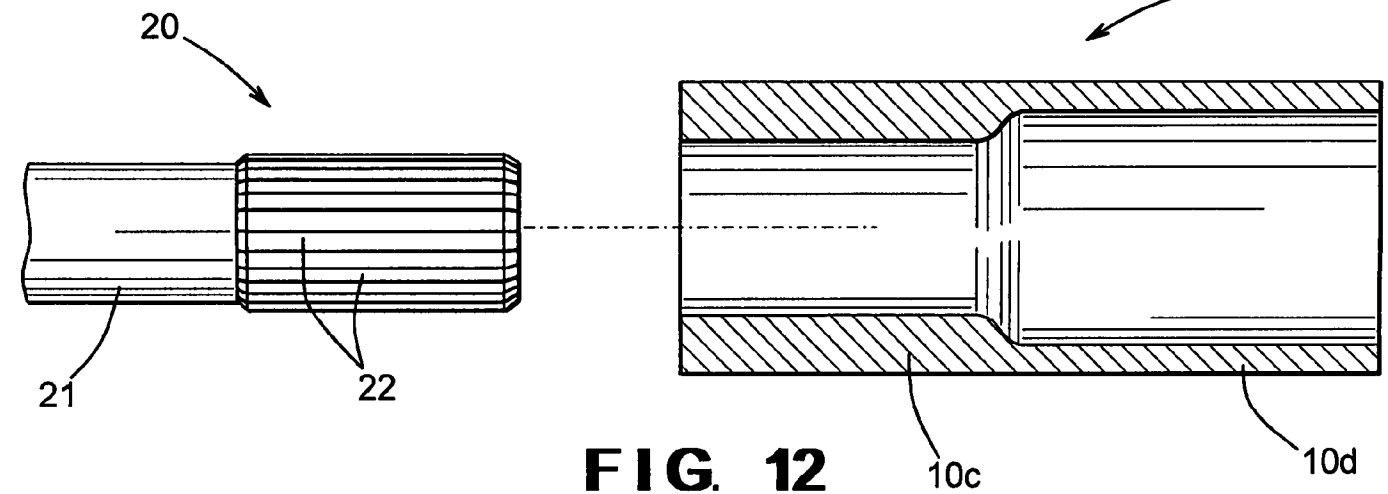
FIG. 12 is an exploded elevational view of a workpiece and a mandrel shown prior to the commencement of a third embodiment of a method of manufacturing a splined member in accordance with this invention.

FIG. 12 is an exploded elevational view of a further modified workpiece, indicated generally at 10", and the mandrel 20 shown prior to the commencement of a third embodiment of a method of manufacturing a splined member in accordance with this invention. In this embodiment of the method of this invention, the further modified workpiece 10" is generally hollow and cylindrical in shape, similar to the workpiece 10 described and illustrated above. However, the further modified workpiece 10" does not have a wall thickness that is generally uniform through the length thereof. Rather, the further modified workpiece 10" has a wall thickness that varies from a thicker portion 10*c* to a thinner portion 10*d*. In this embodiment of the invention, the thicker portion 10*c* of the further modified workpiece 10" and the thinner portion 10*d* of the further modified workpiece 10" are formed from a single piece of material that has been formed to have relative thick and thin wall thickness portions using any conventional process. For example, the thicker portion 10*c* of the further modified workpiece 10" and the thinner portion 10*d* of the further modified workpiece 10" can be formed by a conventional rolling process or by a conventional butted tube extrusion process. The mandrel 20 can be inserted within the thicker portion 10*c* of the further modified workpiece 10" to form the internal splines 13*a* in the manner described above.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A method of manufacturing a splined member comprising the steps of:

(a) providing a workpiece that is formed from a non-heat treatable material comprising a AA-5154 grade aluminum alloy having an elongation characteristic that is in the range of from about 20% to about 30%;

(b) providing a mandrel having a plurality of splines;

(c) deforming the workpiece into engagement with the mandrel to form a splined member.

2. The method defined in claim 1 wherein said step (a) is performed by providing a workpiece that is formed from a material having an elongation characteristic for the material that is in the range of from about 22% to about 28%.

3. The method defined in claim 2 wherein said step (a) is performed by providing a workpiece that is formed from a material having an elongation characteristic that is about 25%.

4. The method defined in claim 1 wherein said step (a) is performed by providing a workpiece that is formed from a material having a relatively low elongation characteristic and subjecting the workpiece to a softening process to provide a relatively high elongation characteristic.

5. The method defined in claim 4 wherein said softening process is a retrogression heat treatment process.

6. The method defined in claim 1 wherein said step (a) is performed by providing a workpiece that has a wall thickness that varies from a thicker portion to a thinner portion.

7. The method defined in claim 6 wherein the thicker portion of the workpiece and the thinner portion of the workpiece are formed from separate pieces of material that are secured together.

8. The method defined in claim 6 wherein the thicker portion of the workpiece and the thinner portion of the workpiece are formed from a single piece of material.

9. The method defined in claim 1 wherein said step (b) is performed by providing a mandrel having a plurality of external splines.

10. The method defined in claim 9 wherein said step (c) is performed by a swaging process to provide a splined member having a plurality of internal splines and a cylindrical outer surface.

11. The method defined in claim 10 wherein said step (a) is performed by rotary swaging.

12. The method defined in claim 10 wherein said step (a) is performed by feed swaging.

* * * * *